US008938833B2

(12) United States Patent
Allard Serrano et al.

(10) Patent No.: US 8,938,833 B2
(45) Date of Patent: Jan. 27, 2015

(54) COMPACT CUTLERY KIT WHICH MANIFESTS ITS PREVIOUS USE THROUGH RELEASE OF ITS PARTS

(76) Inventors: José Manuel Allard Serrano, Santiago (CL); Alberto Alejandro González Ramos, Santiago (CL)

( * ) Notice: Subject to any disclaimer, the term of this patent is extended or adjusted under 35 U.S.C. 154(b) by 170 days.

(21) Appl. No.: 13/384,546

(22) PCT Filed: Oct. 30, 2009

(86) PCT No.: PCT/CL2009/000020

§ 371 (c)(1), (2), (4) Date: Jan. 17, 2012

(87) PCT Pub. No.: WO2011/006275

PCT Pub. Date: Jan. 20, 2011

(65) Prior Publication Data

US 2012/0110746 A1 May 10, 2012

(30) Foreign Application Priority Data

Jul. 15, 2009 (CL) ..... 1597-2009

(51) Int. Cl.
*A47G 21/06* (2006.01)
*B67B 7/16* (2006.01)

(52) U.S. Cl.
CPC ..... *A47G 21/06* (2013.01)
USPC ..... 7/151; 30/142

(58) Field of Classification Search
CPC ..... A47G 21/00; A47G 21/02; A47G 21/06; A47G 19/06; B29C 45/00
USPC ..... 7/112, 113, 169; 30/137, 142, 147–150; 428/221
See application file for complete search history.

(56) References Cited

U.S. PATENT DOCUMENTS 671,740 A * 4/1901 Wattne ..... 30/408
3,829,350 A * 8/1974 Davis, Jr. et al. ..... 428/134

(Continued)

FOREIGN PATENT DOCUMENTS

| | | |
|---|---|---|
| CN | 2159719 | 3/1994 |
| CN | 200994641 | 12/2007 |
| DK | 151174 | 11/1987 |
| JP | 2004261336 | 9/2004 |
| WO | 2007136267 | 11/2007 |

OTHER PUBLICATIONS

International Search Report (ISR), dated Feb. 15, 2010, Int'l Application No. PCT/CL/2009/000020.

*Primary Examiner* — David B Thomas
(74) *Attorney, Agent, or Firm* — Hasse & Nesbitt LLC; Daniel F. Nesbitt

(57) ABSTRACT

A cutlery kit configured from a laminar sheet which manifests its previous use through the detachment of its parts. The kit is comprised of two or more daily, known utensils selected from a spoon, a fork and a knife, which are jointly located in a single plane and are separated by thin, continuous dotted or cut lines. The utensils fit into each other in a complementary form, counter-form way and remain joined together by the presence of continuities in the surface where these continuities interrupt the dotted lines. Each of these cutlery utensils is detached from the others through breaking, done by the user, of these continuities on the surface.

12 Claims, 14 Drawing Sheets

(56) References Cited

U.S. PATENT DOCUMENTS 7,878,563 B2 * 2/2011 Beckham et al. ..... 294/218
7,905,021 B2 * 3/2011 Shirazi ..... 30/147
2007/0033809 A1 * 2/2007 Shirazi ..... 30/147
2007/0101578 A1 * 5/2007 Shirazi ..... 30/147
2009/0200315 A1 8/2009 Blondeel

* cited by examiner

COMPACT CUTLERY KIT WHICH MANIFESTS ITS PREVIOUS USE THROUGH RELEASE OF ITS PARTS

The present invention relates to the field of household disposable items and particularly relates to a set of cutlery which, due to the release system of one utensil over another gives a clear signal of its previous use.

ANTECEDENTS OF THE INVENTION

Since the early 2000s people have been working on solutions to problems using designs from the "primitive geometry" concept, this concept being understood as the only intervention in any type of material to transform it into an object (e.g. material: wire—object: clip or coat hanger).

Considering the concept of primitive geometry solutions have been developed in various fields of the human endeavor, for example:

- Security in airlines
- Organoleptic materials (pleasing to the senses)
- Guarantee of immunity, not having been used before (Hygienic/collapsible)
- Environmental responsibility
- Enhance corporate image
- Innovative advertising
- Logistics (stackable, light, mono-material, "all-in-one" concept -supplements not needed-, compact, etc.)
- Design that does not require instructions ("spoken-form" concept)
- Nobility of materials (switch from steel-coated to plastic)
- Compliance with safety standards (replace use of metals)

In turn, in the prior art a variety of utensil kits with applications in the food industry is described. In particular, one can see in the patent DK 151174 which refers to a set of disposable plastic cutlery consisting of the four elements that usually constitute a set of cutlery, transformed into a set by a connecting piece which allows the utensils to be connected until just before use. The disposable cutlery set is produced in order to provide a clean set of cutlery. The special configuration also enables that the set of cutlery, packaged in plastic or paper, does not use much space so as to facilitate the storage system, for example on board an airplane.

None of the devices known in the prior art show a cutlery utensil kit manufactured from a single sheet where said utensils are separated from each other by the formation of gaps between them so as to form a product attractive to the consumer and cheap to produce.

DETAILED DESCRIPTION OF THE INVENTION

In regard to the group of FIGS. 1A to 1F, one can see that in these figures a kit of cutlery utensils configured from a rigid laminar surface or sheet (1) is described, which manifests its previous use through the intentional release of its parts, well-known and used daily, jointly and substantially located in a single plane. Said utensils are configured partly by gaps (8) interrupting the continuity (7) of the laminar sheet, and some utensils fit into each other in a complementary form or counter-form way, remaining joined together by the presence of continuities on the surface of the sheet. The location of the continuities may be at the end of the defined areas to grasp the utensils or handles or anywhere in between the handles, as shown in FIG. 1I. These gaps (8) are produced through different ways of manufacturing, for example through cold stamping process consisting of a manufacturing operation wherein thermoplastics in sheet form are cold-formed, and a pre-cut thermoplastic sheet, either reinforced or unreinforced, is softened by heating the sheet to a temperature particular to the thermoplastic in use. The heated sheet is then shaped by stamping using a press.

Figure 1A:
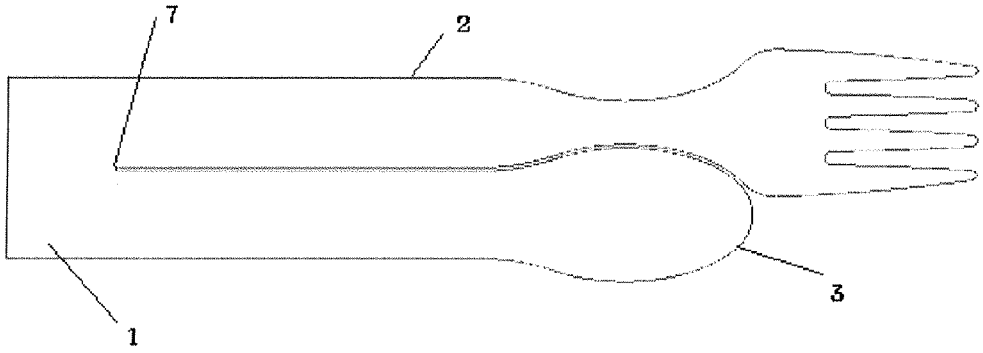
FIGS. 1A-1F. Represent a first group of embodiments of the invention including embodiments with two or three utensils represented in different views.
Figure 1B:
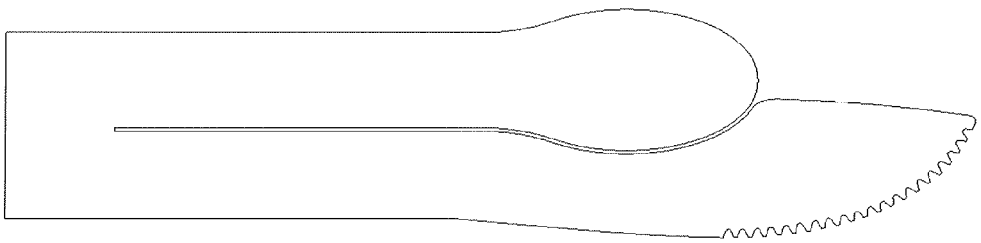
Figure 1C:
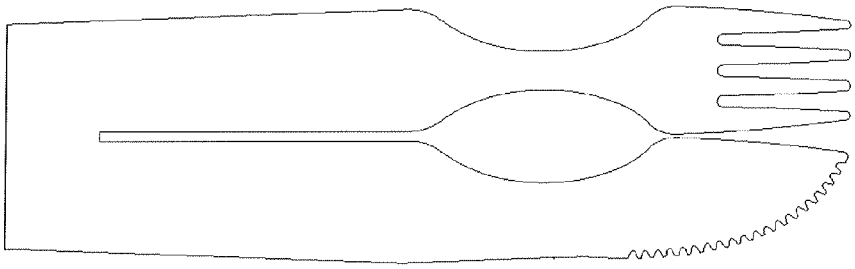
Figure 1D:
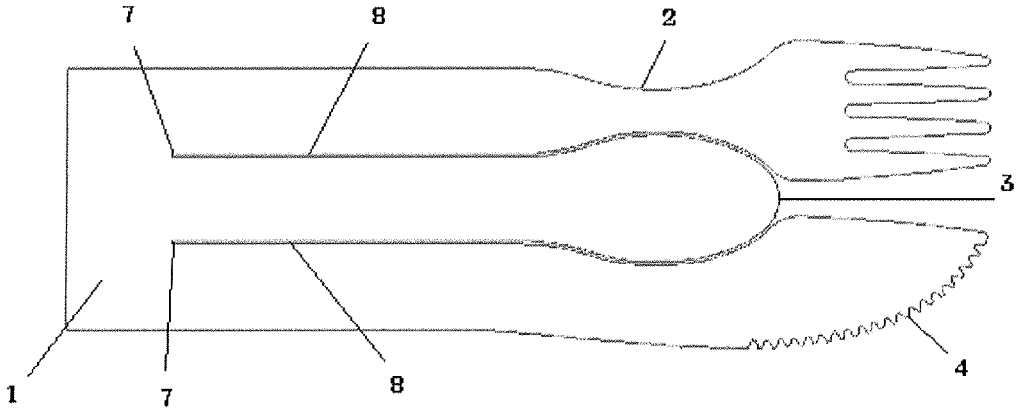
Figure 1E:
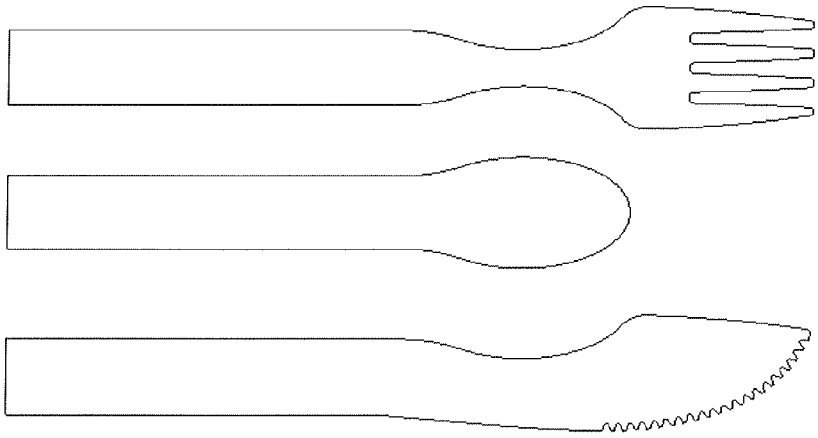

FIGS. 1A, 1B and 1C show embodiments with two utensils which comprise fork-spoon (2-3), spoon-knife (3-4) and fork-knife (2-4), respectively. In turn, the embodiment described in FIG. 1D corresponds to an embodiment with three utensils, consisting of fork (2), spoon (3) and knife (4). In FIGS. 1G and 1H of the three-utensil embodiment, in the space between the head of the fork and the blade of the knife, a toothpick (5) can be included.

Each one of these utensils, whether in an embodiment of two or three utensils, is detached from the others through breaking, done by the user, of these continuities (7) in the surface. In this way, in FIG. 1E, one can see the utensils detached from each other and prepared for use.

Figure 1F:
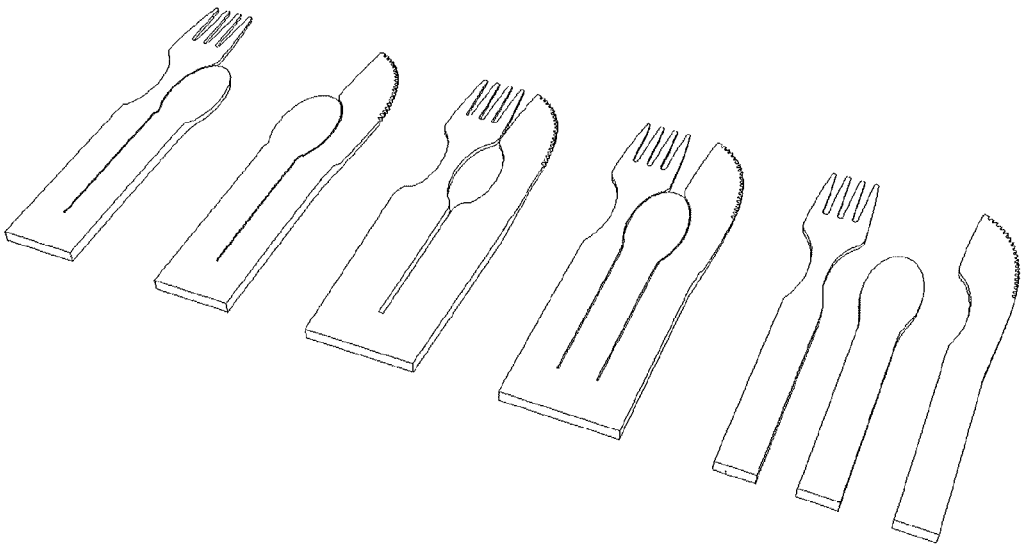
Figure 1G:
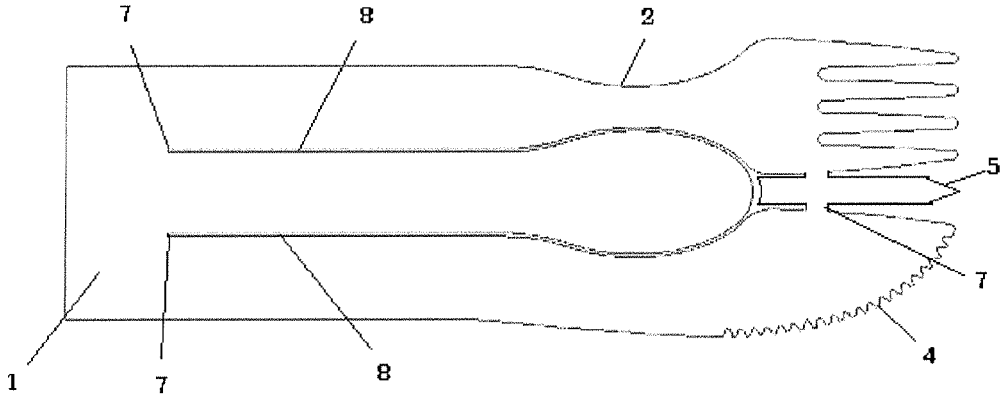
FIG. 1G. Represents the three utensils including a toothpick.
Figure 1H:
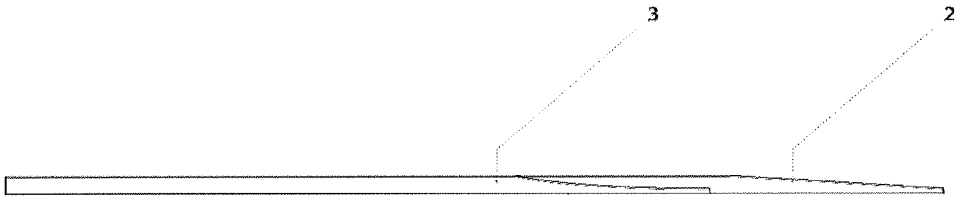
FIG. 1H. Represents a side view showing the difference in thickness of the utensils.
Figure 1I:
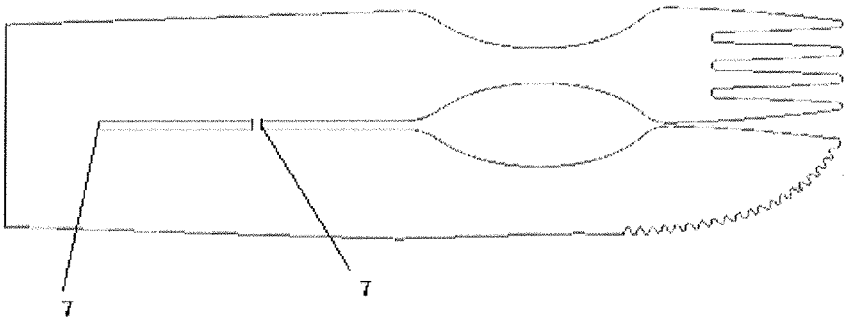
FIG. 1I. Represents a pair of utensils with a continuity between the handles.
Figure 2A:
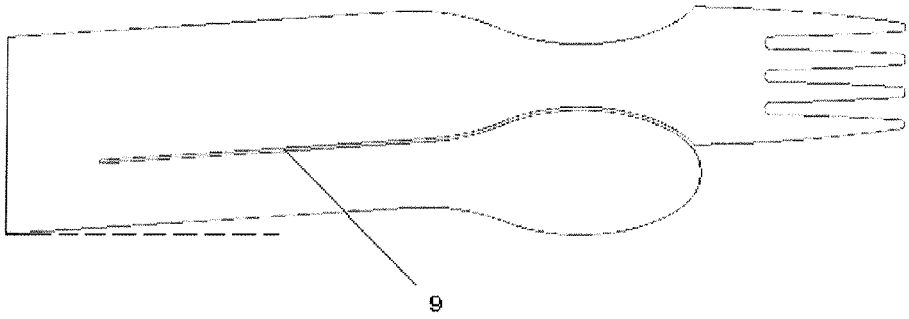
FIGS. 2A-2F. Represent a second group of embodiments of the invention including embodiments with two or three utensils represented in different views.
Figure 2B:
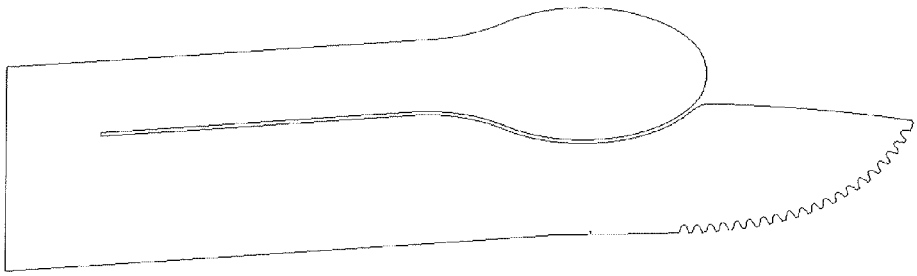
Figure 2C:
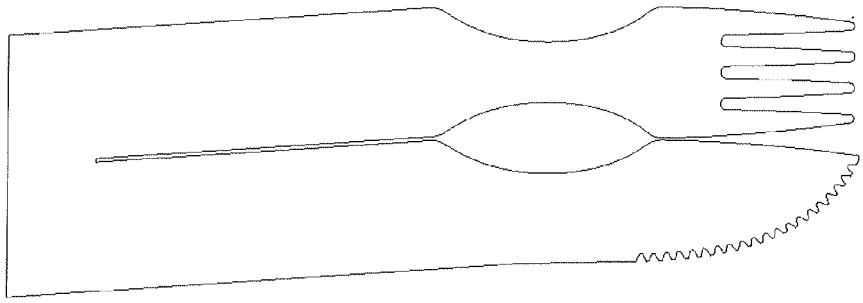
Figure 2D:
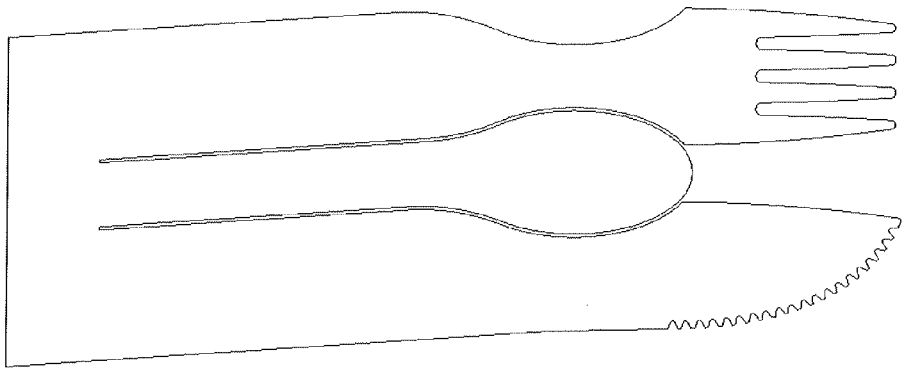
Figure 2E:
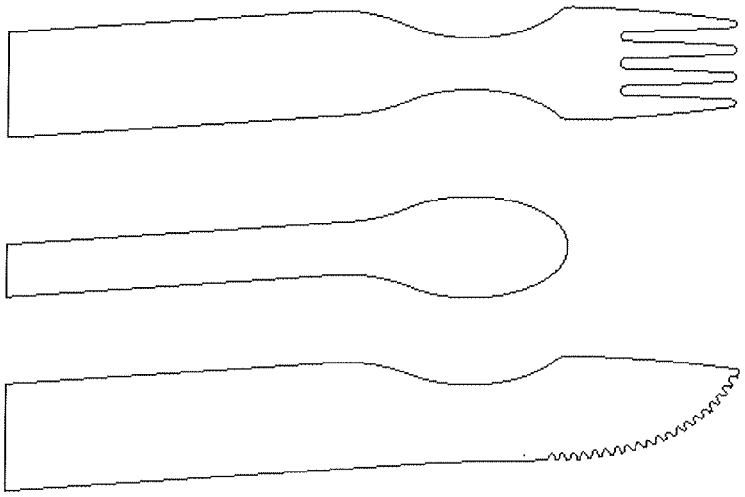
Figure 2F:
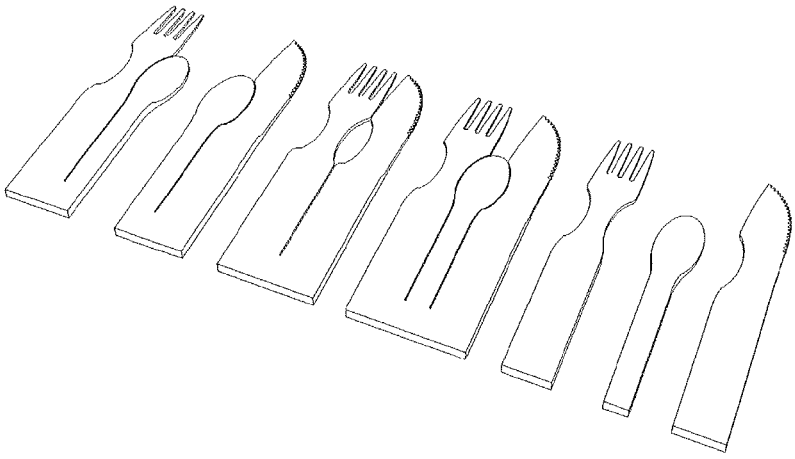
Figure 3A:
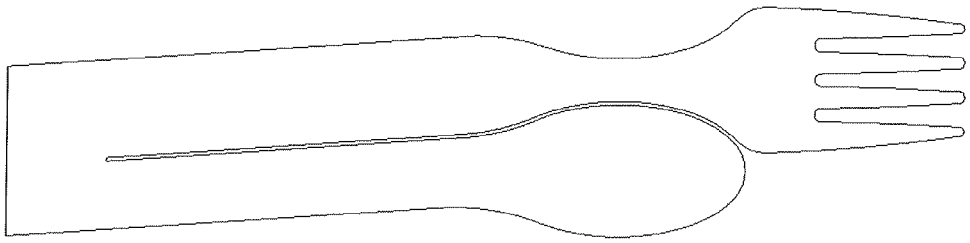
FIGS. 3A-3F. Represent a third group of embodiments of the invention including embodiments with two or three utensils represented in different views.
Figure 3B:
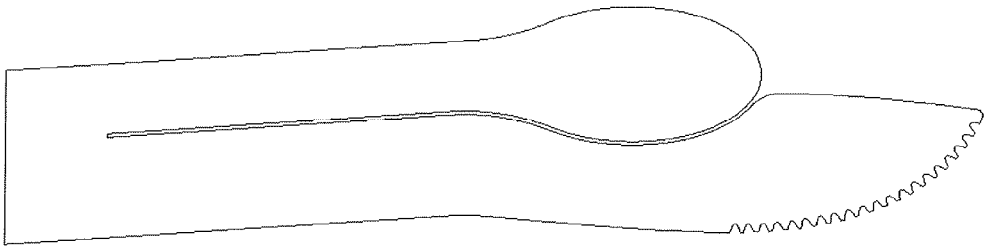
Figure 3C:
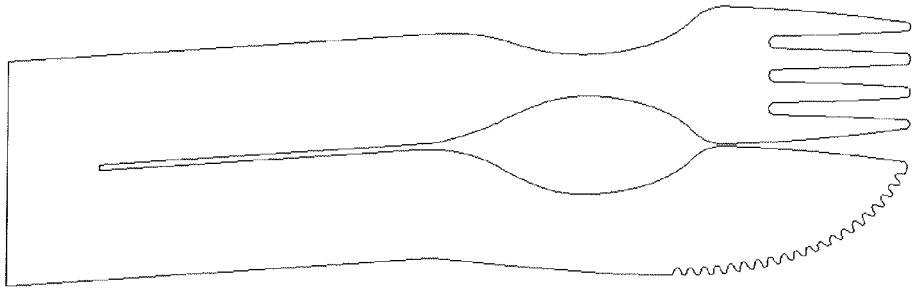
Figure 3D:
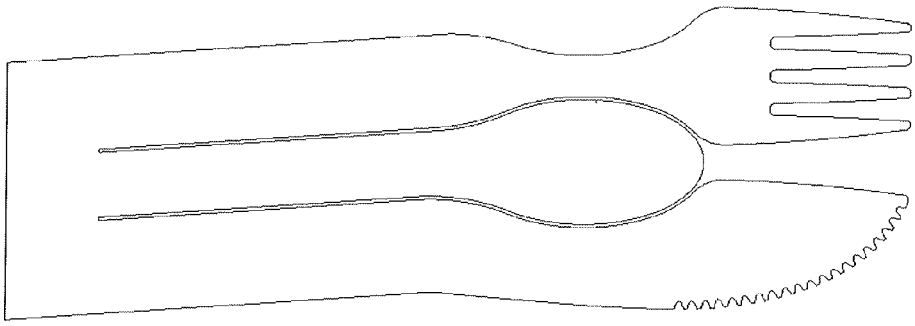
Figure 3E:
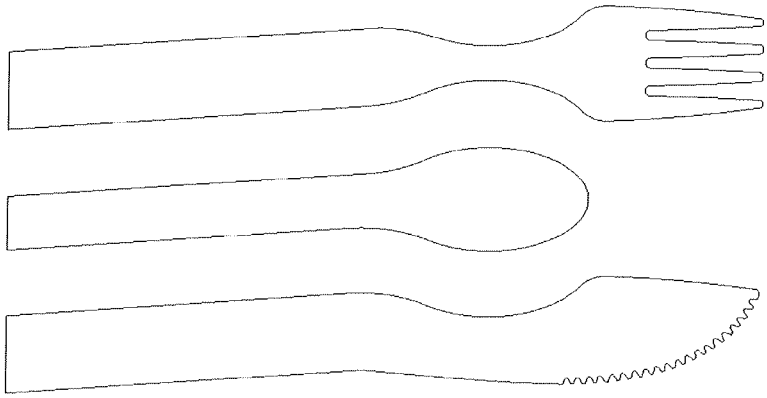
Figure 3F:
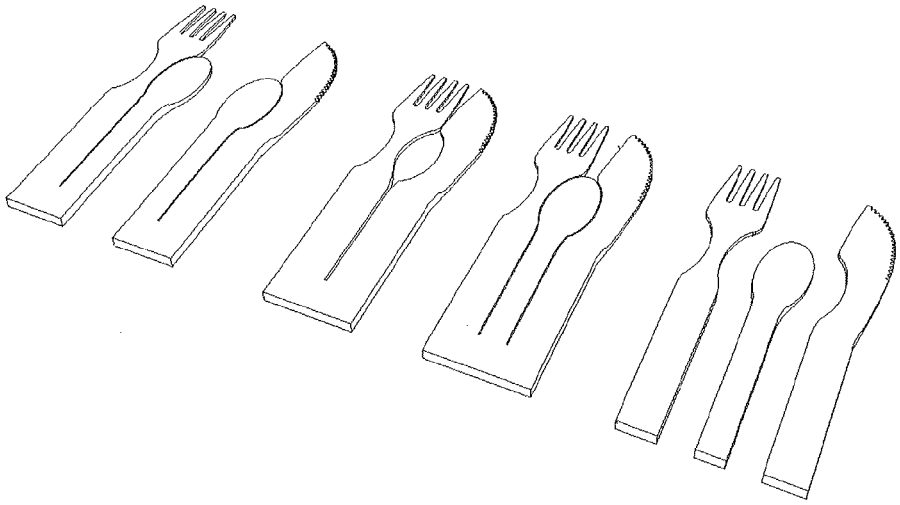
Figure 4A:
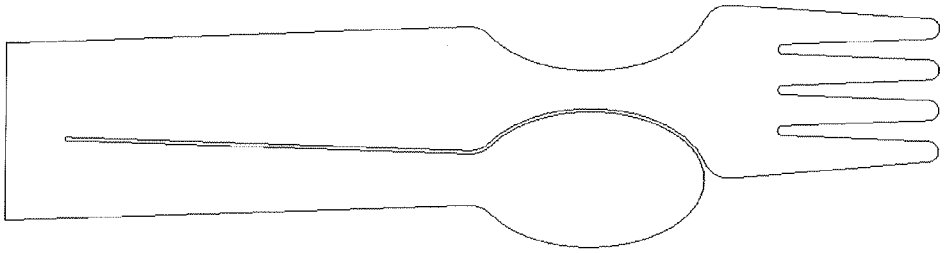
FIGS. 4A-4F. Represent a fourth group of embodiments of the invention including embodiments with two or three utensils represented in different views.
Figure 4B:
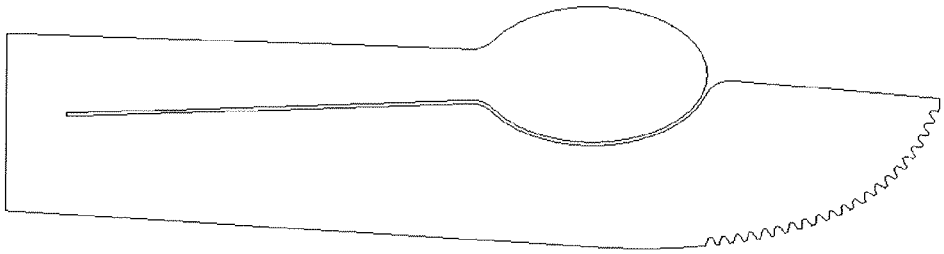
Figure 4C:
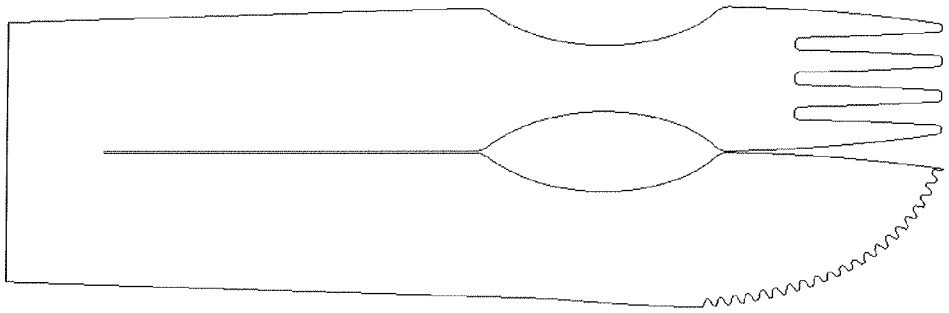
Figure 4D:
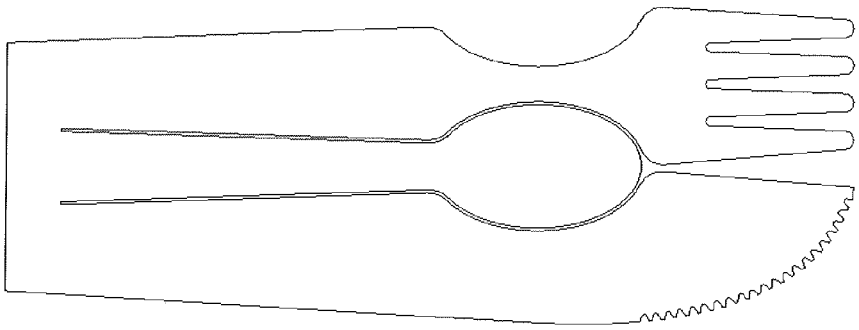
Figure 4E:
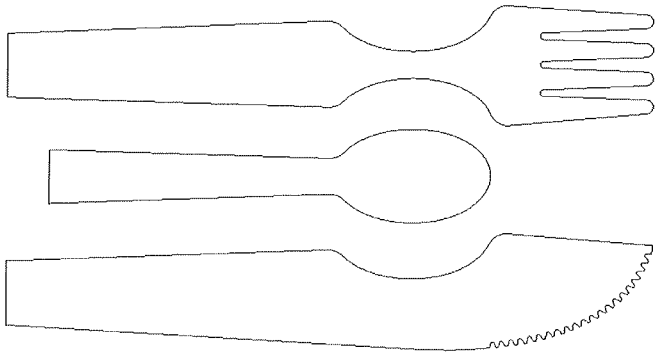
Figure 4F:
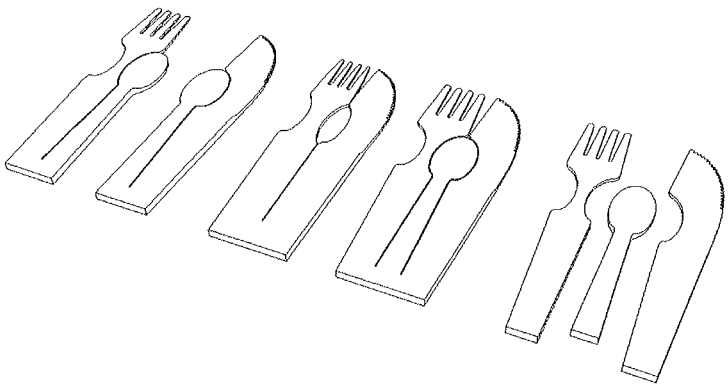

FIG. 1F, in turn, shows perspective views of each of the embodiments describe in FIGS. 1A-1E.

It can be indicated that the referred laminar surface or sheet (1) may have different thicknesses in order to achieve some desired effects in the utensils. In the case of the spoon, in the area of the head, the laminar surface or sheet (1) may have a reduced thickness in order to constitute a recipient for facilitating the consumption of liquids. On the other hand, in the area of the handles or the area for grasping the utensils, the laminar surface or sheet (1) may have a greater thickness so as to provide a greater resistance to bending.

The group referred to as FIGS. 2A-2F show an alternative embodiment of the invention which has established a parallel inclination of the gaps (9) defining the separation between the utensils wherein this inclination is additionally parallel to the outer edges of the laminar sheet. Similarly, it applies to all the embodiments shown by the group of figures referred to as 3A-3F and 4A-4F. In the latter case, the inclination of the gaps (9) is opposite each other and in turn is opposite the edges of said laminar sheet.

Figure 5A:
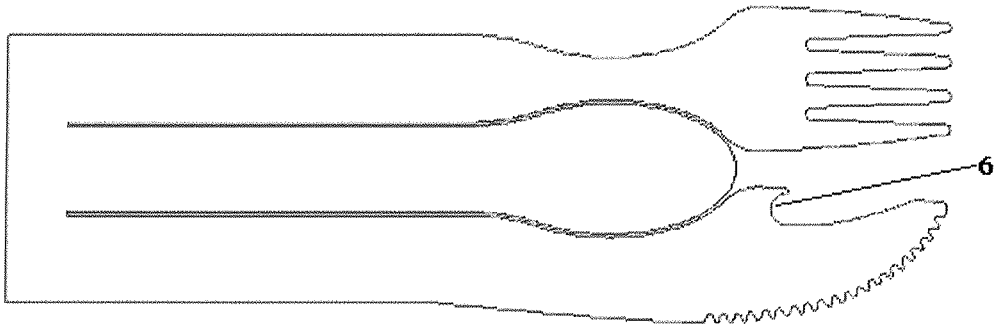
FIGS. 5A-5B. Represent a fifth group of embodiments of the invention including embodiments with two or three utensils represented in different views and with the addition of an element for uncapping bottles and beverages.
Figure 5B:
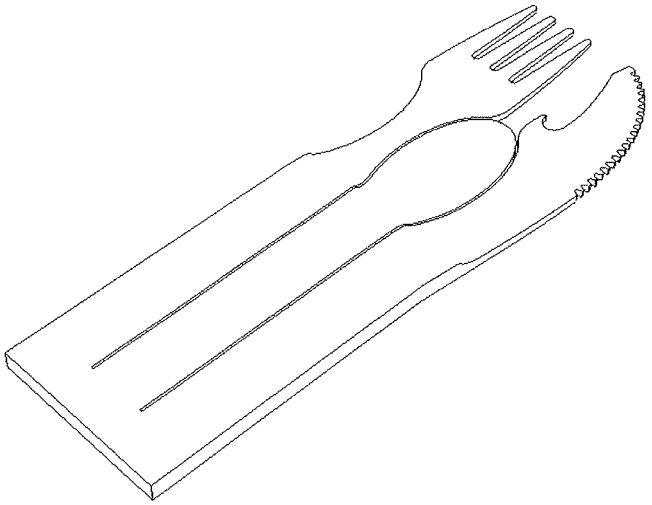

The embodiment described in FIG. 5 represents an option in which the head of one of the utensils, particularly the knife, contains an element shown as a hook (6) for uncapping beverage bottles.

Finally, even though it does not show a limitation in the scope of the invention, it can be stated that the base material for the production of this kit, which is to say, said rigid laminar sheet, is made of wood, cardboard, plastic, aluminum and, in general, any bendable material.

The invention claimed is:

1. A cutlery kit configured from a single rigid laminar sheet, the kit comprising two or more daily, well-known utensils jointly and substantially located in a single plane where the utensils are configured partly by one or more gaps interrupting the continuity of the single sheet for detachment of the utensils from the single sheet by the user before using the utensils, and wherein the utensils fit into each other in a complementary form and remain joined together by the presence of continuities in the sheet.

2. The cutlery kit according to claim 1 wherein each of the utensils is released from the others through breaking, done by the user, of these continuities in the sheet.

3. The cutlery kit according to claim 2 wherein the location of the continuities may be at the end of a defined area to grasp the utensils or handles, or between the handles.

4. The cutlery kit according to claim 3 wherein the location of the continuities are at the end of the defined grasping area, with the one or more gaps between the handles of the utensils.

5. The cutlery kit according to claim 2 wherein the kit is composed of a combination of at least two different cutlery utensils.

6. The cutlery kit according to claim 2 wherein the kit further includes a toothpick.

7. The cutlery kit according to claim 2 wherein the kit further includes an element for uncapping beverage bottles.

8. The cutlery kit according claim 2 wherein the laminar sheet may have different thicknesses in order to achieve a desired effect in the cutlery.

9. The cutlery kit according to claim 8 wherein the laminar sheet has a reduced thickness in order to comprise a recipient for facilitating the consumption of liquids.

10. The cutlery kit according to claim 8 wherein the laminar sheet may have a greater thickness in some areas so as to provide a greater resistance to bending.

11. The cutlery kit according to claim 2 wherein the rigid laminar sheet is made of wood, cardboard, plastic, aluminum, or a bendable material.

12. The cutlery kit according to claim 2 wherein a pair of utensils are joined together by two or more gaps.

* * * * *